US006168131B1

(12) United States Patent
Tabatabaie

(10) Patent No.: US 6,168,131 B1
(45) Date of Patent: Jan. 2, 2001

(54) ICE CUBE TRAY AND DISPENSER

(75) Inventor: Mehdi Tabatabaie, Woodside, NY (US)

(73) Assignee: Business World Trade, Inc., Woodside, NY (US)

( * ) Notice: Under 35 U.S.C. 154(b), the term of this patent shall be extended for 0 days.

(21) Appl. No.: 09/369,504

(22) Filed: Aug. 6, 1999

(51) Int. Cl.[7] ..... B28B 7/24; B28B 7/26

(52) U.S. Cl. ..... 249/121; 249/119; 249/127; D15/90

(58) Field of Search ..... 249/119, 121, 249/127; 222/146.6, 556; D15/90

(56) References Cited

U.S. PATENT DOCUMENTS

| | | | | |
|---|---|---|---|---|
| D. 281,882 | | 12/1985 | Prommer . | |
| D. 352,045 | | 11/1994 | Daenen et al. . | |
| 3,135,101 | * | 6/1964 | Nigro | 62/344 |
| 3,829,056 | * | 8/1974 | Baker et al. | 249/121 |
| 4,162,780 | * | 7/1979 | Rankin | 249/127 |
| 4,804,083 | | 2/1989 | Weeks . | |
| 4,883,251 | | 11/1989 | Manas . | |
| 4,967,995 | | 11/1990 | Burgess . | |
| 5,188,744 | | 2/1993 | Silverman . | |
| 5,196,127 | * | 3/1993 | Solell | 249/121 |
| 5,397,097 | * | 3/1995 | Dale | 249/121 |

* cited by examiner

*Primary Examiner*—James P. Mackey
*Assistant Examiner*—Emmanuel S. Luk
(74) *Attorney, Agent, or Firm*—Collard & Roe, P.C.

(57) ABSTRACT

An ice cube storage and dispensing unit having an ice cube tray tray with a plurality of ice cube compartments and a plurality of slits along one of the longitudinal edges. There is a cover is removably secured to the ice cube tray which creates a closed space above the ice cube tray. The cover has an open end. There are a plurality of latches located along the bottom edge of one of the longitudinal side walls of the cover. The latches engage the slits in the ice cube tray to pivotally attach the cover to the ice cube tray. There is a flange located around the bottom edge of the other longitudinal side wall that releasably engages a groove in the other longitudinal edge of the ice cube tray to releasably lock the cover over the ice cube tray. There is a flap in the top surface of the cover near the free end to create a slot and a door at the open end of the cover to seal the space above the ice cube tray. The door is pivotally attached to one of the side walls and has a panel inserted into the slot. The panel slides within the cavity as the door is opened and shut. Ice cubes formed in the tray are released from the tray and stored in the cover when the tray is inverted, and selectively removed from the cover through the door. The cubes are thus stored in a compact, closed environment, yet are easily accessible by pivoting open the door.

4 Claims, 3 Drawing Sheets

ICE CUBE TRAY AND DISPENSER

BACKGROUND OF THE INVENTION

1. Field of the Invention

This invention relates to an ice cube storing and dispensing unit. In particular, the invention relates to an ice cube tray having a detachable cover that stores and dispenses the ice cubes out of a sliding door at the end of the cover.

2. The Prior Art

Typical ice cube trays are molded plastic trays having multiple compartments for forming ice cubes. When the cubes are set, the tray is twisted and the cubes become dislodged and fall out. The cubes are then transferred to a bin for use and storage.

Since people often have limited space in their freezers, a separate bin for holding the ice cubes is often inconvenient. In addition, an open bin makes the ice cubes susceptible to absorbing odors from the freezer. In addition, the open ice cube trays themselves are susceptible to spills as well as the absorption of odors.

Ice cube trays with covers are known. For example, U.S. Pat. No. 5,188,744 to Silverman discloses an ice cube tray having a sliding cover so as to let the user dispense only a desired number of ice cubes from the tray while keeping the rest in their separate compartments.

U.S. Pat. No. 4,967,995 to Burgess discloses a combination cover and dispenser for an ice cube tray. The cover slides over the entire tray and covers the ice cubes while they are being frozen. To dispense the cubes, the cover is slid over only the top of the tray, giving a large clearance space above the tray. The cubes can then be dispensed out from the end of the cover.

U.S. Pat. No. 4,883,251 to Burgess discloses a container for making ice cubes having a large compartment above the ice cube tray, and a dispensing aperture located at an end of the compartment. Other types of ice cubes trays are shown in U.S. Pat. No. 4,804,083 to Weeks, U.S. Design Pat. No. D352,045 to Daenen et al. and U.S. Design Pat. No. D281, 882 to Prommer.

While all of these trays provide for the formation and storage of ice cubes, it would be desirable to have an ice cube tray in which the cover was removable and simple to operate.

SUMMARY OF THE INVENTION

It is therefore an object of the invention to provide an ice cube tray having a detachable cover.

It is another object of the invention to provide an ice cube storage and dispensing unit that allows for the selective dispensing of ice cubes in a simple manner.

It is another object of the invention to provide an ice cube storage and dispensing unit that is simple and inexpensive to manufacture.

These and other objects of the invention are accomplished by a combination ice cube tray and cover in which the ice cube tray has a plurality of ice cube compartments, two longitudinal edges and two lateral edges and a plurality of slits along one of the longitudinal edges. The cover is removably secured to the ice cube tray and creates a closed space above the ice cube tray. The cover has a top surface, two longitudinal side walls, an end wall and an open end. There are a plurality of latches located along the bottom edge of one of the longitudinal side walls. The latches engage the slits in the ice cube tray to pivotally attach the cover to the ice cube tray. There is a flange located around the bottom edge of the other longitudinal side wall that releasably engages a groove in the other longitudinal edge of the ice cube tray to lock the cover over the ice cube tray.

There is a flap in the top surface of the cover near the free end, which creates a slot between the cover and the flap. There is a door at the open end of the cover to seal the space above the ice cube tray. The door is pivotally attached to one of the longitudinal side walls. The door has a top panel that is inserted into the slot. The top panel slides within the cavity as the door is opened and shut. In use, the ice cubes formed in the ice cube tray are released from the ice cube tray and stored in the cover when the tray is inverted, and selectively removed from the cover through the door. The cubes are thus stored in a compact, closed environment, yet are easily accessible by pivoting open the door.

In a preferred embodiment, the free edge of the cover and the flap each have a protrusion thereon. The top panel of the door has a protrusion along one of its free edges. When the cover is opened, the protrusion on the top panel abuts the protrusions on the cover and flap and prevents the door from being opened beyond a predetermined amount. This keeps the door from coming completely out of the slot, and makes it easier to slide the door open and closed repeatedly.

The side walls and end wall of the cover have a height greater than the height of the ice cube compartments to allow the cubes to be freely stored in the cover upon removal from the ice cube compartments. The top panel has the shape of a quarter circle, with the rounded edge being inserted within the slot when the door is closed, and sliding out of the slot when the door is opened. This top panel provides a convenient pouring spout as the ice cubes exit out of the free end of the cover and fall between the door and the free end.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
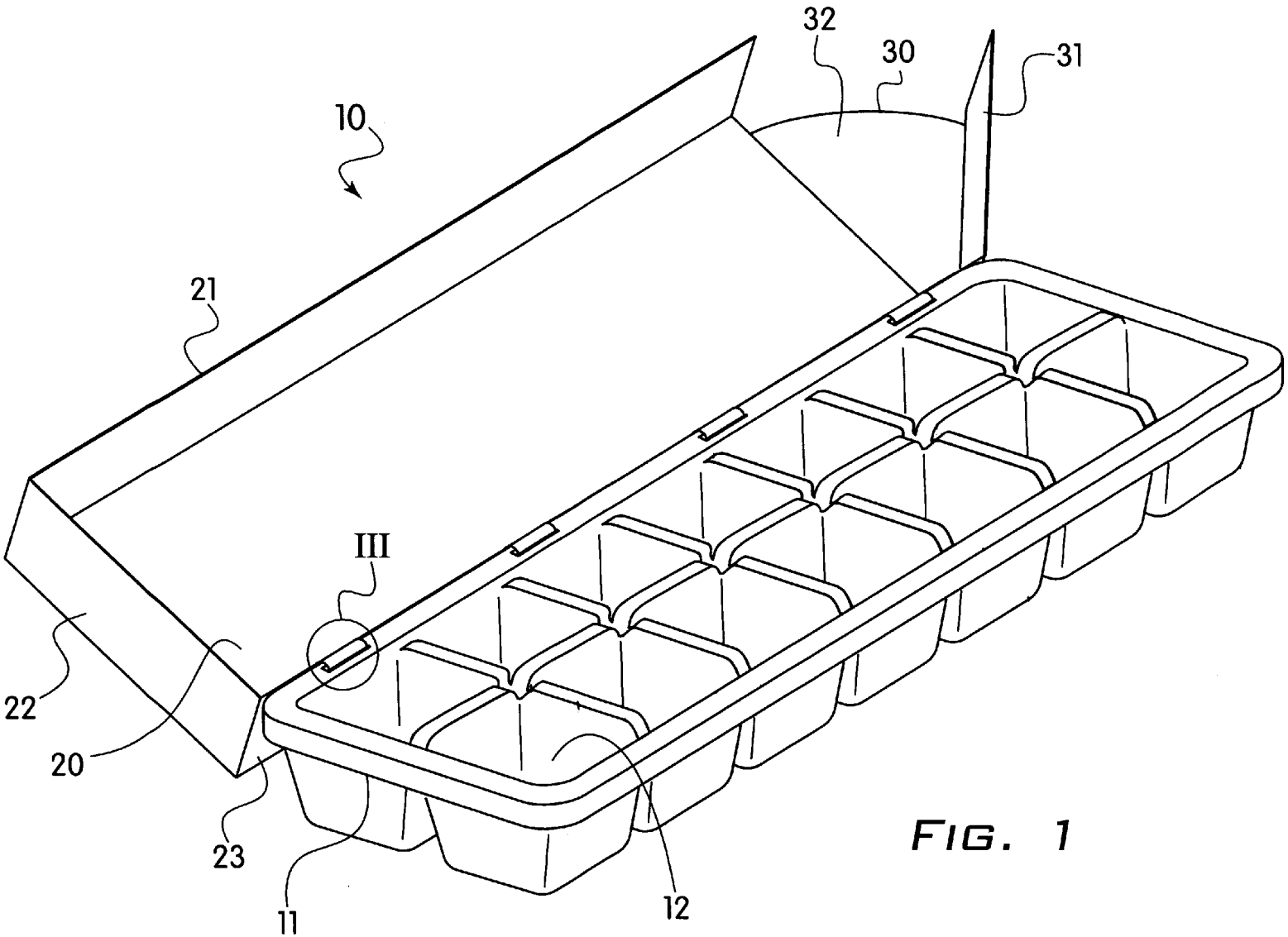
FIG. 1 shows a perspective view of the ice cube tray and cover with the cover opened.
Figure 2:
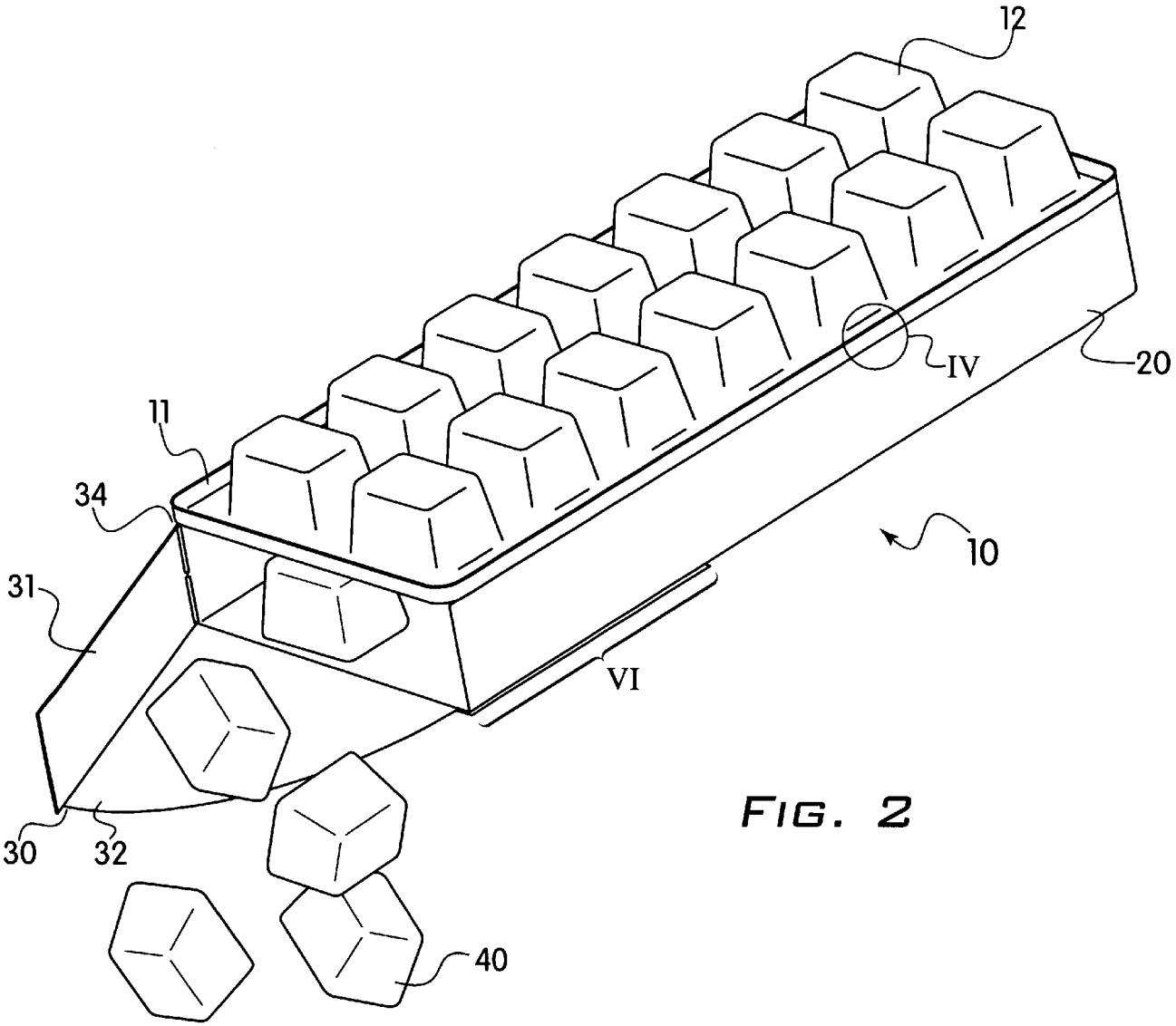
FIG. 2 shows a perspective view of the ice cube tray and cover in the inverted pouring position with the door opened.

Referring now in detail to the drawings and, in particular, FIGS. 1 and 2, there is shown the ice cube dispenser 10 according to the invention. Dispenser 10 comprises an ice cube tray 11 and a cover 20. Tray 11 has several compartments 12 for making ice cubes. Tray 11 is preferably formed from a stiff, yet flexible material, so that the ice cubes formed therein can be dislodged from compartments 12 by twisting tray 11.

Figure 3:
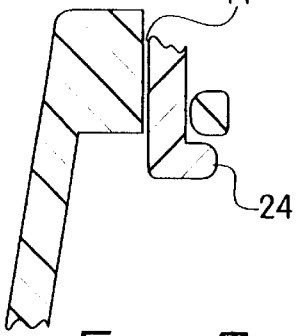
FIG. 3 shows a cross sectional view of portion III of FIG. 1.

Cover 20 is removably connected to tray 11 along one edge via a plurality of snap-in hinge connections, shown in FIG. 3. Cover 20 has a plurality of latches 24 which snap into slits 14 in ice cube tray 11 to create a hinge connection along one edge. Cover 20 has three side walls 21, 22 and 23, which, when cover 20 is closed over ice cube tray 11, create a storage compartment for the ice cubes after they are dislodged from compartments 12.

Figure 4:
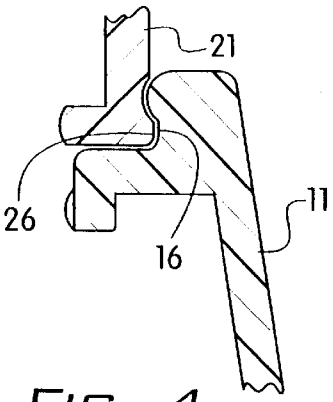
FIG. 4 shows a cross sectional view of portion IV of FIG. 2.

Cover 20 is secured closed over ice cube tray 11 by a flange 26 along the free edge of wall 21, which releasably engages a groove 16 in the edge of ice cube tray 11, as shown in FIG. 4.

Figure 5:
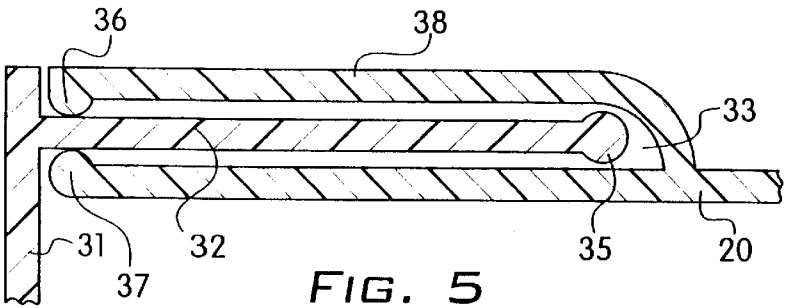
FIG. 5 shows a cross-sectional view of section VI of FIG. 2 except with the door closed.
Figure 6:
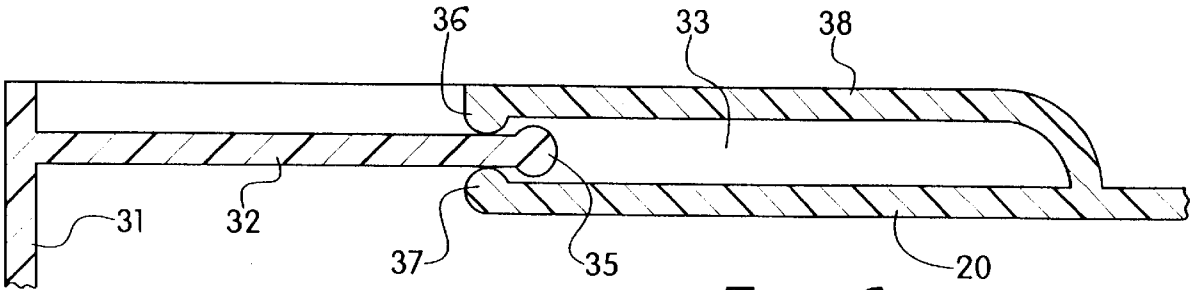
FIG. 6 shows a cross-sectional view of section VI of FIG. 2 with the door opened.

Along the edge of cover 20 opposite wall 22, there is a door 30. Door 30 comprises a vertical wall 31 connected along one edge to a platform 32. As shown in FIGS. 5 and 6, there is a flap 38 formed in the surface of cover 20 to form a slot 33 between cover 20 and flap 38. Platform 32 slides within slot 33 and allows door 30 to pivot open and closed via hinge 34 (shown in FIG. 2). Door 30 creates a simple way to dispense a desired number of ice cubes 40 from cover 20, by pivoting open door 20 and tilting dispenser 10 until the dislodged ice cubes slide out. If only a small number of ice cubes are desired, door 20 is opened only a small amount, to prevent all of the ice cubes 40 from sliding out quickly.

To prevent platform 32 from coming completely out of slot 33, and therby preventing re-insertion of platform 33 when closing door 30, a protrusion 35 is disposed on the end of platform 33. As shown in FIG. 6, protrusion 35 abuts protrusions 36 and 37 on slot 30 and cover 20 when door 30 is opened, and prevents platform 33 from sliding completely free. Thus, door 30 can be easily opened and closed in a secure manner.

Accordingly, while only a single embodiment of the present invention has been shown and described, it is obvious that many changes and modifications may be made thereunto without departing from the spirit and scope of the invention.

What is claimed is:

1. An ice cube storage and dispensing unit comprising:

an ice cube tray having a plurality of ice cube compartments, two longitudinal edges and two lateral edges and a plurality of slits along one of said longitudinal edges; and a cover removably secured to said ice cube tray and creating a sealed space above said ice cube tray, said cover having a top surface, two longitudinal side walls, an end wall, and a free edge, each of said walls having a bottom edge, and comprising:

a plurality of latches located along the bottom edge of one of said longitudinal side walls, said latches engaging the slits in the ice cube tray to pivotally attach said cover to said ice cube tray;

a flange located around the bottom edge of said other longitudinal side wall, said flange releasably engaging the other longitudinal edge of said ice cube tray to lock the cover over the ice cube tray;

a flap in said top surface located near the free edge of the cover, said flap creating a slot;

a door opposite said end wall, said door sealing the space above the ice cube tray and being pivotally attached to one of said longitudinal side walls and having a top panel inserted into the slot, said top panel having two free edges and sliding within the slot as the door is opened and shut;

wherein ice cubes formed in the ice cube tray are released from the ice cube tray and stored in the cover when the tray is inverted, and selectively removed from the cover by pivoting the door open.

2. The ice cube dispenser according to claim 1, wherein the free edge of the cover and the flap each have a protrusion thereon and wherein the top panel of the door has a protrusion along one free edge, wherein the protrusion on the top panel abuts the protrusions on the cover and flap when the door is opened and prevents further opening of the door.

3. The ice cube dispenser according to claim 1, wherein the side walls and end wall of the cover have a height greater than the height of the ice cube compartments.

4. The ice cube dispenser according to claim 2, wherein the top panel has the shape of a quarter circle.

* * * * *